US009400151B1

(12) United States Patent
Edsall

(10) Patent No.: US 9,400,151 B1
(45) Date of Patent: Jul. 26, 2016

(54) SEMI-AUTOMATIC FIREARM SUPPRESSOR

(71) Applicant: Richard A. Edsall, Ashton, MD (US)

(72) Inventor: Richard A. Edsall, Ashton, MD (US)

( * ) Notice: Subject to any disclaimer, the term of this patent is extended or adjusted under 35 U.S.C. 154(b) by 0 days.

(21) Appl. No.: 14/606,452

(22) Filed: Jan. 27, 2015

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34
See application file for complete search history.

(56) References Cited

U.S. PATENT DOCUMENTS 1,111,202 A * 9/1914 Westfall ..... F41A 21/30 181/223
1,525,846 A * 2/1925 Wurtzebach ..... F41A 21/30 181/223
1,773,443 A * 8/1930 Zygmunt ..... C09B 49/10 89/14.4
3,667,570 A * 6/1972 WerBell, III ..... F41A 21/30 181/223
3,677,132 A * 7/1972 Plenge ..... F41A 21/30 42/1.14
3,713,362 A * 1/1973 Charron ..... F41A 21/30 89/14.4
5,029,512 A * 7/1991 Latka ..... F41A 21/30 181/223
8,561,757 B1 * 10/2013 Edsall ..... F41A 21/30 181/223
9,038,771 B1 * 5/2015 Mueller ..... F41A 21/30 181/223

* cited by examiner

*Primary Examiner* — Troy Chambers
*Assistant Examiner* — Bridget Cochran
(74) *Attorney, Agent, or Firm* — Lieberman & Brandsdorfer, LLC

(57) ABSTRACT

Embodiments of the invention relate to a dynamic suppression mechanism for a semi-automatic firearm. An axial mass is positioned adjacent to multiple dynamic volume chambers, which are aligned within a housing. An aperture is provided within the mass and aligned chambers to accommodate the projectile. As the projectile travels through the aperture across the length of the housing, each of the chambers is subject to a dynamic expansion and contraction, with the dynamic volume change absorbing byproduct of the traveling projectile.

21 Claims, 4 Drawing Sheets

SEMI-AUTOMATIC FIREARM SUPPRESSOR

FIELD OF THE INVENTION

The present invention relates to a firearm apparatus and a method for suppressing noise associated with movement of a projectile. More specifically, the present invention mitigates noise associated with the projectile as it travels through a tubular housing of the firearm during discharge, while allowing a semi-automatic firearm to cycle.

BACKGROUND

Firearms function by discharging a projectile through an associated firearm housing. A semi-automatic firearm is a type of handgun which utilizes energy of a fired cartridge, also referred to herein as a projectile, to cycle an action of the firearm and advance the next available projectile into position for firing. One round is fired each time a trigger of the firearm is activated, e.g. pulled. During use, the projectile travels through the housing at an accelerated speed and then discharges to a target or target vicinity. One byproduct of the projectile traveling through the housing is noise. It is known in the art to employ a suppressor, also known as a silencer, to reduce the noise associated with the projectile discharge. Various configurations have been employed to reduce noise.

SUMMARY OF THE INVENTION

The present invention relates to apparatuses for mitigating noise associated with discharge of a projectile from a semi-automatic firearm while enabling the firearm to cycle.

In one aspect of the invention, an apparatus is provided with a tubular housing secured to a muzzle end of a firearm. The tubular housing defines a hollow interior that surrounds a path along which a projectile can travel when subject to discharge. More specifically, the tubular housing has two ends defined as a first end and a second end. The first end is secured to the muzzle end of the firearm, and the second end is oppositely disposed. Within the tubular housing there are multiple dynamic volume chambers that extend from the first end to the second end with a projectile path formed through the length of the housing. Within the tubular housing, an axial mass is provided to enable a semi-automatic firearm to cycle between adjacent rounds of discharge.

In another aspect, an apparatus is provided with a tubular housing configured to secure to a muzzle end of a firearm. The tubular housing defines a hollow interior that surrounds a path along which a projectile can travel. More specifically, the tubular housing has a first end and a second end. The first end of the housing is secured to the muzzle end of the firearm, and the second end of the housing is oppositely disposed. The tubular housing includes multiple dynamic volume chambers therein, with the chambers disposed between the first and second ends. An alignment of the apertures forms a projectile path. Within the tubular housing there is also an axial mass and axially variable material positioned with respect to the chambers. The placement of the mass together with the material, both with respect to the chambers, enables a semi-automatic firearm to cycle between adjacent rounds of discharge.

Other features and advantages of this invention will become apparent from the following detailed description of the presently preferred embodiments of the invention taken in conjunction with the accompanying drawings.

BRIEF DESCRIPTION OF THE DRAWINGS

The drawings referenced herein form a part of the specification. Features shown in the drawings are meant as illustrative of only some embodiments, and not of all embodiments unless otherwise explicitly indicated. Implications to the contrary are otherwise not to be made.

DETAILED DESCRIPTION

As noted, suppression of noise from a firearm is not a new concept. Prior art configurations of noise suppressors employ fixed baffles, which is a static approach to resolving the aspect of noise suppression. At the same time, prior art configurations do not support use of a suppressor with a semi-automatic firearm that enables cycling of cartridges without the use of a secondary device. Accordingly, there is a need for a dynamic solution that functions to reduce energy of gases propelled from a projectile exiting an associated semi-automatic firearm muzzle, while supporting the functionality of the cycling of the semi-automatic firearm.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of noise supporting elements for a firearm and an associated projectile associated therewith to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

Figure 1:
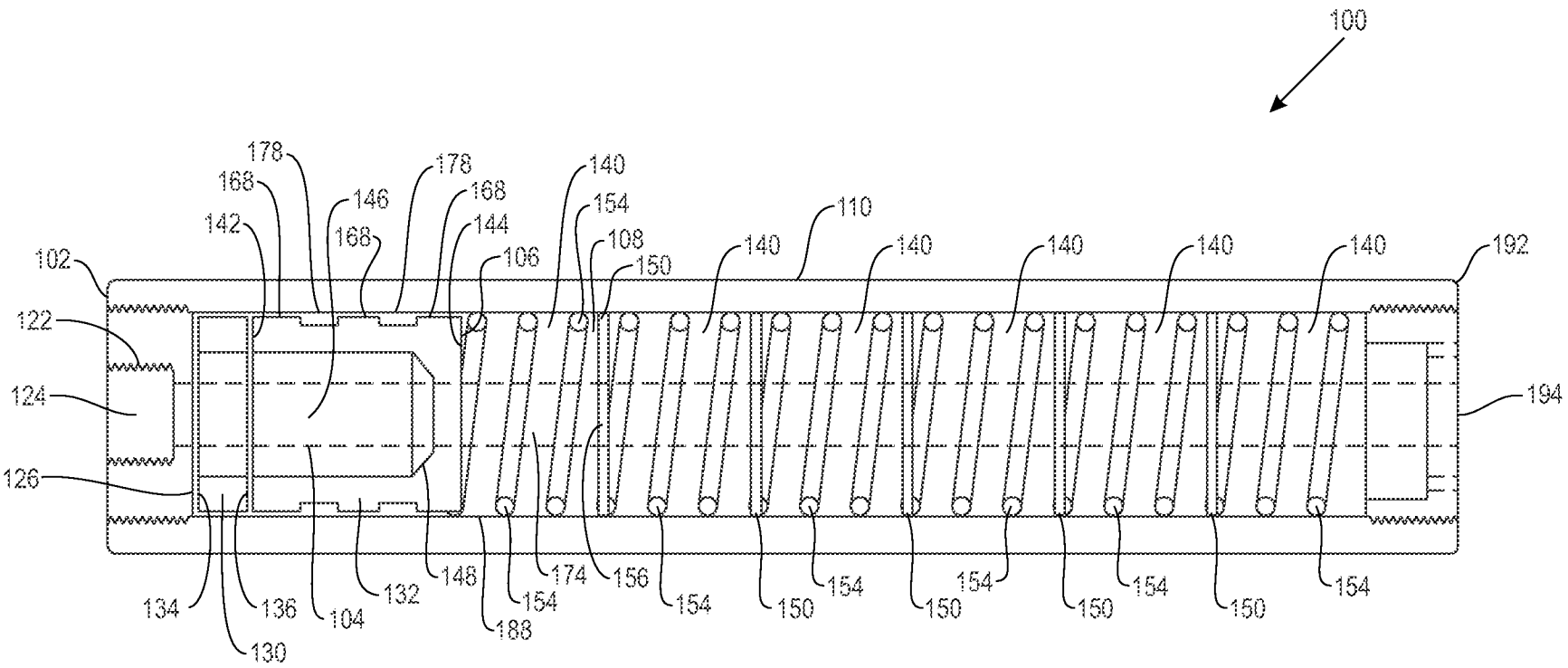
FIG. 1 depicts a plan view of a noise suppressor for a firearm with an axial mass to support recharge of a semi-automatic firearm.

A noise suppressor for a firearm utilizing concepts of the invention is illustrated in FIG. 1. FIG. 1 is a plan view of a noise suppressor (100) for a firearm with an axial mass to support recharge of a semi-automatic firearm. The suppressor includes an annular shaped housing (110), also referred to as a tubular shape, having a first end (102) and a second end (192). The first end (102) includes a threaded interior wall (122) configured to be secured to or in communication with threads of a barrel of a firearm (not shown). In one embodiment, the first end (102) may be alternatively configured and secured to the barrel of the firearm. The threaded interior wall (122) is one embodiment that may be employed for the securement. As shown, the threaded interior wall (122) has an annular aperture (124) that extends from the first end (102) to an interior second end (192). The size of the aperture is configured with a diameter that is greater than the diameter of a projectile exiting from the barrel of the firearm. In one embodiment, the aperture (124) is aligned with a projectile path (104). Accordingly, the threaded interior wall (122) is configured to secure directly or indirectly to the barrel of the firearm and sized to receive a projectile exiting the barrel.

Several components are positioned within the housing (110), including a rebound ring (130), also referred to herein as a ring, an axial mass (132), also referred to herein as a mass, dynamic volume chambers (140), and separators (150). Details and positioning of these components are described in detail below. The threaded interior wall (122) is shown adjacent to the first end (102) of the housing (110). The interior second end (126) of the threaded wall is shown adjacently positioned to the ring (130). More specifically, the ring (130) functions as an interface between the mass (132) and the first end (102). The ring (130) has an annular shape and is provided with two opposing ends, including a first end (134) and a second end (136). The first end (134) is positioned adjacent to the interior second end (126), and the second end (136) is positioned adjacent to the mass (132). An opening (138) is provided within the ring (130) aligned with the projectile path (104), and sized to receive the projectile. In one embodiment, the ring (130) is comprised of a silicone material, a wave spring, or an alternate material with similar properties. The material enables the ring (130) together with the mass (132) and associated chamber (140) to function with or without application of a lubricant. Accordingly, the ring (130) is provided within the tubular shaped housing (110) of the suppressor and positioned adjacent to both the threaded interior wall (122) of the first end (102) and the mass (132).

As shown in FIG. 1, the mass (132) has an annular shape sized to be received in the housing (110). The mass (132) is configured with a first end (142) and an oppositely disposed second end (144). The mass (132) is provided with an opening (146), which in one embodiment has an annular shape. Opening (146) is aligned with the projectile path (104) and is sized to receive the projectile. In one embodiment, an interior profile of the opening (146) with the load (132) is tapered (148) adjacent to a second end (144), although this shape is not considered limiting. As shown, the tapering includes a larger diameter opening of the mass from the first end (142) to the second end, with the tapering at (148) narrowing the diameter of the opening within the mass. In one embodiment, the larger opening acts as an expansion chamber allowing the gas to expand, with the tapering at (148) functioning as funnels to force the gas into a smaller opening. In one embodiment, the funnel associated with the tapering (148) forces the mass to move in an axial direction with the emission of a projectile. In one embodiment, the axial mass may have different internal opening configurations, and as such the axial mass configuration shown and described herein should not be considered limiting.

Furthermore, as shown herein the external profile of the mass (132) is shown with detents representing two different outer diameter profiles. From a section perspective, the detents are shown at (168) and corresponding indents are shown at (178). The indents (178) represent a smaller outer diameter than the detents (168), and are shown herein as an opening between the mass (132) and the internal wall (188) of the housing (110). In one embodiment, the mass (132) moves in an axial direction, both on a forward path toward the second end (192) and on a return path toward the first end (102). In one embodiment, the detents (168) function to clear debris away from the surface of the internal wall (188). In one embodiment, debris is the byproduct associated with travel of the projectile through the housing (110). Accordingly, the indents (178) and detents (168) of the mass (132) together with the axial movement of the mass (132) removes debris from the internal wall (188).

Multiple dynamic volume chambers (140) are provided within the housing (110) and are positioned sequentially between the mass (132) and the second end (192) of the housing (110). The positioning of the mass (132) within the housing (110) provides several functions, including protecting the firearm, allowing cycling, and suppressing noise from a discharged round. Details of the functionality are described in detail below.

As shown, there is a plurality of dynamic volume chambers (140). Although six chambers are shown and described herein, this quantity should not be considered limiting. Each set of adjacently positioned chambers includes a separator (150), therebetween. In the example shown herein, there are five separators (150). In one embodiment, the separators are comprised of a metallic material. Each of the separators is positioned between two adjacently positioned chambers or between the mass (132) and an adjacently positioned chamber (140). Accordingly, a mass (132), multiple dynamic volume chambers (140) are provided within the housing (110) of the suppressor, positioned sequentially, and separated by separators (150).

Each dynamic volume chamber is identical to an adjacently mounted dynamic volume chamber, and will be described herein with specificity with respect to the first dynamic volume chamber (140). As shown, the dynamic volume chamber (140) includes a hydraulic absorbing material (154) that extends the length of the chamber. In one embodiment, the absorbing material (154) is any material configured to absorb shock and sound, i.e. compression and rarefaction of ambient gas. More specifically, each chamber (140) has a first end (106) and a second end (108). With respect to the first chamber (140), the first end (106) is adjacent to and in communication with the axial mass (132) and the second end (108) defines the distal boundary of the chamber (140). A separator (150) is provided adjacent to the distal boundary of the first chamber (140). Each separator (150) between adjacent chambers is in communication with adjacently positioned hydraulic absorbing material (154) within an associated chamber.

Each absorbing material and each adjacently mounted separator is configured and aligned with an aperture sized to receive a projectile. As shown in the first chamber, the first absorbing material (154) is configured with aperture (174), and separator (150) is configured with aperture (156). Both of these apertures (174) and (156) are at or near the same diameter and are aligned together and with the aperture (124) of the threaded wall (122), and more specifically, are components of the projectile path (104). Each of the sequential chambers are configured with separate absorbing materials, with each absorbing material configured with an aperture that aligns with and forms the projectile path (104), as described in detail with respect to the first chamber. Accordingly, a projectile discharged from the firearm may travel an axial path, referred to herein as the projectile path (104), formed by the aligned apertures through the housing (110).

As shown in the example herein, there are six dynamic volume chambers, with the sixth chamber being the furthest disposed from the firearm and adjacent to the second end (192). Upon completion of travel of the projectile through the sixth chamber, the projectile will exit the housing (110) through the exit (194).

Each of the dynamic volume chambers illustrated in FIG. 1 are shown in a rest state wherein the hydraulically absorbing material is compressed. In one embodiment, the absorbing material may be in the form of a spring or an elastomer, or any material that is axially variable, i.e. changes shape along an axis, with the rest state including the absorbing material in a compressed state. As the projectile enters the first chamber (140), the absorbing material de-compresses and expands thereby causing movement of the first separator (150) in a lateral direction. In one embodiment, the housing (110) is comprised of a non-expanding material; as such the expansion limits of each absorbing material are limited to the lateral direction. The projectile travels through the housing one chamber at a time. As the projectile exits the first chamber (140), the absorbing material (154) returns to a rest state, i.e. compressed form, and moves in the process, while the second chamber (140) receives the projectile with the second absorbing material (154) de-compressing as the projectile travels through the second chamber. Each separator (150) is sized so that an exterior edge is in communication with an interior wall of the housing (110). As such, as each separator is subject to axial movement associated with compression and de-compression of the absorbing material, debris that is in communication with the interior wall of the housing (110) is removed from the wall.

As the projectile travels through the housing (110) and each chamber therein, the projectile emits a byproduct. In one embodiment, the byproduct is a gas emitted by the projectile. Similarly, in another embodiment, the byproduct may include percussive energy, sound energy, and/or shock from the projectile. In both forms, the byproduct causes an expansion of the hydraulic absorbing material that extends the length of the associated chamber. Once the projectile exits the chamber, the material returns to an equilibrium state, i.e. compressed. Accordingly, the byproduct of the projectile causes the hydraulic absorbing material to change from a compressed state to an expanded state, and then to return to the compressed state upon discharge of the projectile.

In the embodiments shown in FIG. 1, the suppressor is shown with a plurality of adjacently positioned chambers, and each of the chambers including hydraulic absorbing material. The suppressor may include a minimum of one chamber between the axial mass and the second end of the annular shaped housing, or expanded to include two or more additional chambers. The absorbing material may include a variety of material. In one embodiment, the absorbing material is in the form of a spring with each spring to extend the length of the chamber in which it is housed. In one embodiment, the material of the spring enables the spring, or any material that absorbs compression and rarefaction of gas, to withstand a temperature up to 550 degrees Fahrenheit. The separators, one per chamber, may be in the form of a washer, machined annular sleeve, ring of metal, etc., with each separator having an aperture sized to receive the projectile and a width sized to the width of the chamber so that the separator may remove debris that forms along the interior wall of the suppressor.

In the embodiments shown in FIG. 1, the mass (132) provides an aspect of noise suppression for semi-automatic firearms. Upon firing, a round enters the tubular shaped housing (110) of the suppressor. The blast force from expanding gases follow the projected round, hit the face of the mass (132) at the first end of the housing (110). The gases force the mass (132) against the sequentially positioned dynamic volume chambers. The sequential positioning of dynamic volume chambers absorb the mechanical shock of the force communicated by the mass (132). Accordingly, the mass (132) diminishes the attenuating mechanical shock from a discharged round.

Reducing the mechanical shock, as described herein, pulls the suppressor away from the barrel of the firearm, which further reduces the shock or suddenness of the signature sound of the shot and shot concussion. Accordingly, the use of the mass (132) reduces an ability to identify a location of the shooter based on the sound of the shot fired.

The sequentially positioned, dynamic volume chambers proceed in a forward direction, away from the first end (102) of the housing (110), as described above, to reduce attenuating mechanical shock associated with a discharged round. In one embodiment, the mass (132) proceeds in a backward direction, away from the second end (192) of the housing (110). Specifically, the mass (132) rebounds against the ring (130) and the sequentially positioned, dynamic volume chambers. In one embodiment, the first dynamic volume chamber is a proximal spring. In doing so, the motion of the mass (132) absorbs the mechanical shock of the sequentially positioned, dynamic volume chambers. To that end, the lateral motion of the mass (132) between the ring (130) and the sequentially positioned, dynamic volume chambers prevents damage to the inside of the suppressor as the mass (132) returns to its former position. At the same time, in the case of a semi-automatic firearm, the motion of the mass (132) enables the firearm to cycle and place the next cartridge in position for discharge. Accordingly, the use of the mass (132) in a semi-automatic firearm reduces mechanical damage to the firearm as the firearm cycles and provides efficiency with respect to discharging a subsequent projectile.

The position of the mass (132) within the housing (110) with respect to the chambers enables a semi-automatic firearm to cycle. More specifically, the cycling presents a subsequent projectile to load, thereby enabling automatic continuity of firing of adjacently positioned or loaded projectile rounds.

Figure 2:
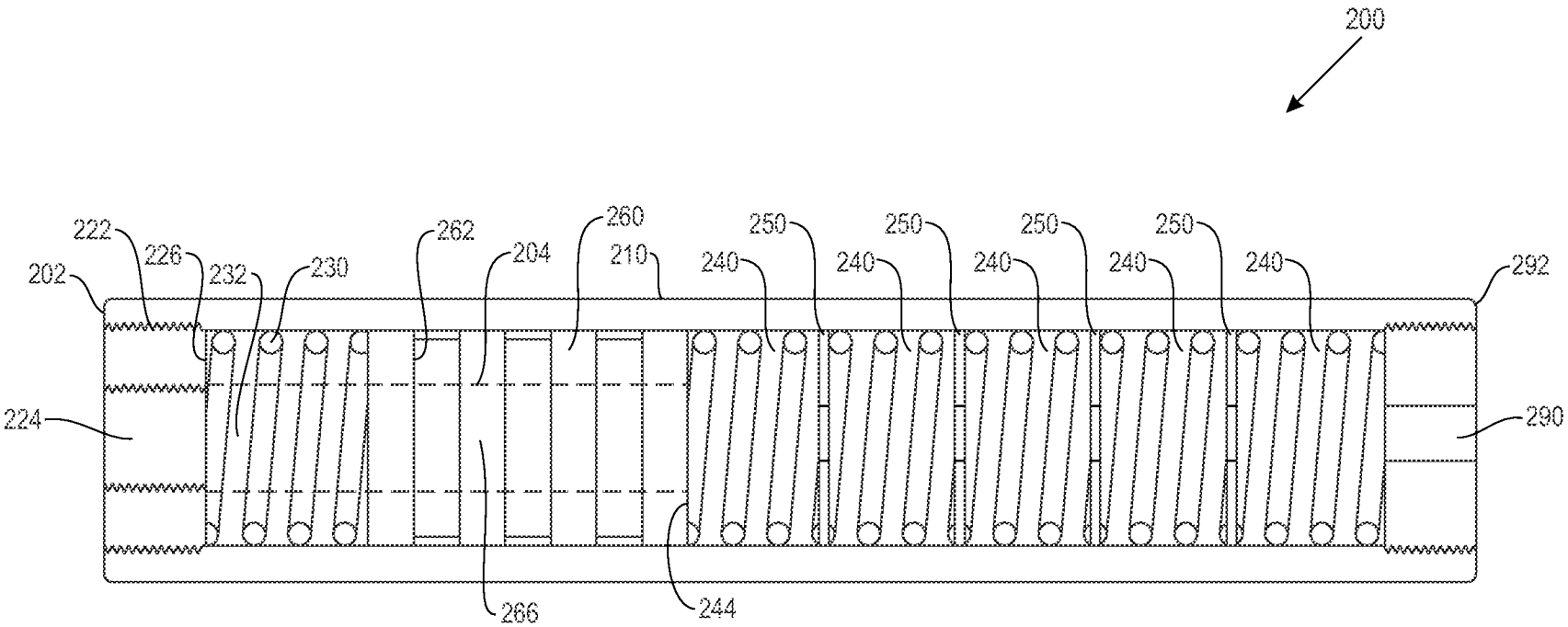
FIG. 2 depicts a sectional view of one embodiment of the noise suppressor shown and described in FIG. 1.

Referring to FIG. 2, a sectional view (200) of an embodiment of the noise suppressor of FIG. 1 is shown and described. The suppressor includes a tubular shaped housing (210) having a first end (202) and a second end (292). The first end (202) includes a threaded interior wall (222) configured to be secured to or in communication with threads of a barrel of a firearm (not shown). In one embodiment, the first end (202) may be alternatively configured and secured to the barrel of the firearm. The threaded interior wall (222) is one embodiment that may be employed for the securement. As shown, the threaded wall (222) has an annular aperture (224) that extends from the first end (202) to an interior section (226) of the suppressor. The aperture (224) is configured and sized with an opening that is greater than the diameter of a projectile exiting from the barrel of the firearm. In one embodiment, the aperture (224) is aligned with a projectile path (204). Accordingly, the threaded interior wall (222) is configured to secure directly or indirectly to the barrel of the firearm and sized to receive a projectile exiting the barrel.

Several components are positioned within the housing (210), including a rebound spring (230) and axial mass (260), dynamic volume chambers (240), and separators (250). The chambers (240) and separators (250) are shown and described in detail in FIG. 1. Details and positioning of these components are described in detail below. The threaded interior wall (222) is shown adjacent to the first end (202) of the housing (210). The interior second end (226) of the threaded interior wall (222) is adjacently positioned to a first axially variable material (230). In one embodiment, the first axially variable material (230) comprises a spring and is referred to herein as a rebound spring. The first material (230) functions as an interface between the threaded wall (222) and mass (260). The first material (230) is provided with an opening (232) that aligns with and forms part of the projectile path (204) and is and sized to receive the projectile.

The mass (260) has an annular shape and is positioned within the housing (210). The mass (260) is configured with a first end (262) positioned adjacent to material (230) and an oppositely disposed second end (244) positioned adjacent to chamber (240). The mass (260) is provided with an opening (266), which is aligned with the projectile path (204), and the opening and the path are sized to receive the projectile. As shown, the mass (260) together with the first chamber (240) is positioned adjacent to the first end (202) of the tubular shaped housing (210). Furthermore, the mass (260) has a central aperture (266), which in one embodiment is tapered to accommodate fluid byproduct and expansion gas from the projectile. The mass (260) attenuates shock transmitted to the barrel of the percussive firearm to ease tension and compression of the attachment device (210). At the same time, the position of the mass (260) within the housing and with respect to the chambers enables a semi-automatic firearm to cycle. More specifically, the cycling presents a subsequent projectile to load; thereby enabling automatic continuity of firing of adjacently positioned or loaded projectile rounds.

Figure 3:
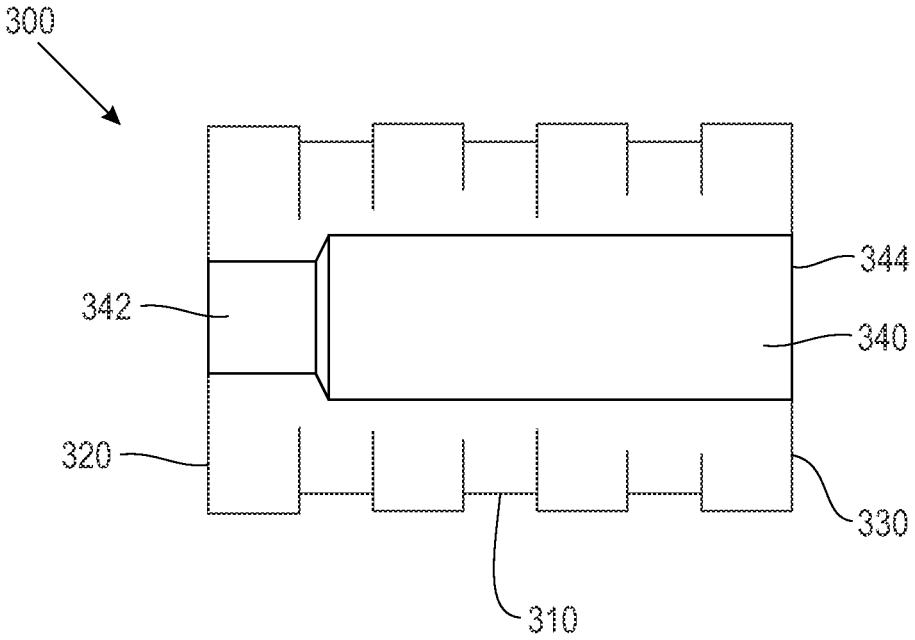
FIG. 3 depicts a sectional view of an axial mass configured to be positioned within the noise suppressor shown and described in FIGS. 1 and 2.

Referring to FIG. 3, a sectional view (300) of the axial mass is shown and described. The mass (310) has an annular shape with an aperture formed therein. More specifically, the mass (310) includes a first end (320) and a second end (330). The aperture (340) extends through the interior of the mass continuously from the first end (320) to the second end (330). In one embodiment, the aperture (340) has an annular shape and is sized to receive the projectile, and in one embodiment has an opening larger than the size of the projectile. As shown herein, the aperture (340) has a non-uniform size. More specifically, a first end of the aperture (342) has an opening sized smaller than a second end of the aperture (344). In one embodiment, the sizing is to accommodate the gas and fluid byproducts associated with the projectile.

Figure 4:
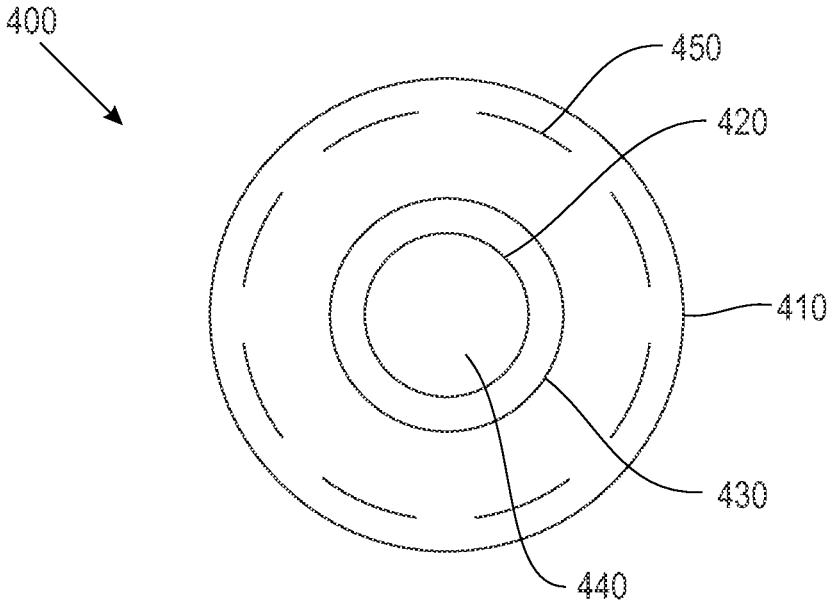
FIG. 4 depicts an end view of the axial mass.

Referring to FIG. 4, an end view (400) of the mass is shown. The mass (410) has an exterior wall and a concentric aperture (440). The first end of the aperture (420) is represented with the narrow opening. Similarly, the second end of the aperture (430) is shown with a larger annular opening. The hidden line(s) shown at (450) represents the indents of the axial mass, shown and described in detail in FIG. 1.

Figure 5:
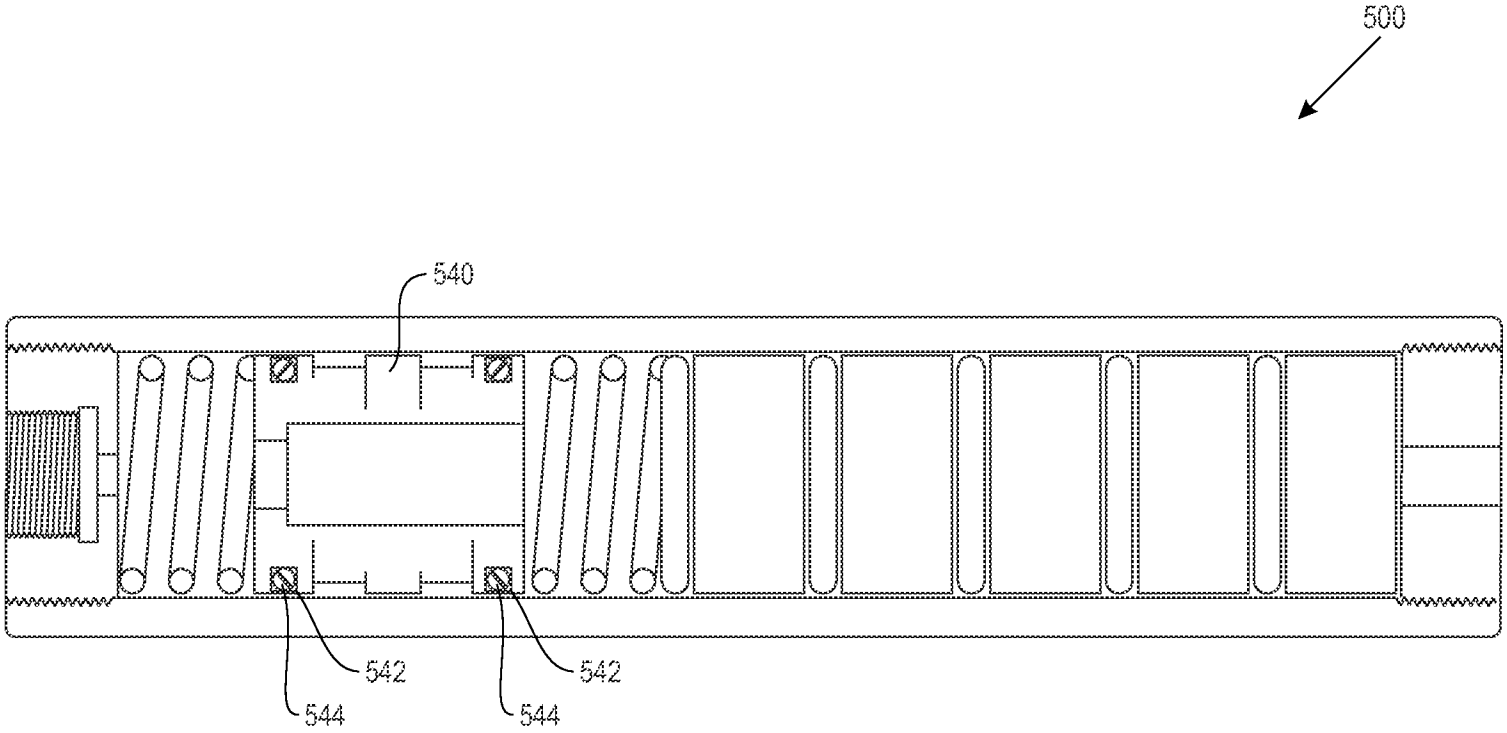
FIG. 5 depicts a sectional view of an embodiment of the noise suppressor.

Referring to FIG. 5, a sectional view (500) of an embodiment of the noise suppressor is shown. The mass (540) is shown herein with a similar positioning as the mass shown and described in FIG. 2. An annular exterior opening (542) also referred to herein as an indentation, is provided and sized to receive a washer (544) or an equivalent functional element. In one embodiment, the washer is comprised of a silicone material. In one embodiment, the mass (540) has two openings (542), placed adjacent to opposite ends of the mass (540) and each sized to receive a washer (544). As articulated above, the position of the mass (540) within the housing, and with respect to the chambers, enables a semi-automatic firearm to cycle. More specifically, the cycling presents a subsequent projectile to load, thereby enabling automatic continuity of firing of adjacently positioned or loaded projectile rounds.

In the embodiments shown and described in FIGS. 1-5, the suppressor is shown with a plurality of adjacently positioned chambers, and each of the chambers including hydraulic absorbing material. The suppressor may include a minimum of one chamber between the axial mass and the second end of the annular shaped housing, or expanded to include two or more additional chambers. The absorbing material may include a variety of materials. In one embodiment, the absorbing material is in the form of a spring with each spring to extend the length of the chamber in which it is housed. In one embodiment, the material of the spring enables the spring, or any material that absorbs compression and rarefaction of gas, to withstand a temperature up to 550 degrees Fahrenheit. The separators, one per chamber, may be in the form of a washer, machined annular sleeve, ring of metal, etc., with each separator having an aperture sized to receive the projectile and a width sized to the width of the chamber so that the separator may remove debris that forms along the interior wall of the suppressor.

In one embodiment, the chambers may be comprised an alternative compressive material. The chamber may be configured with a sleeve comprised of a material to absorb compression and rarefaction of ambient gas, hereinafter referred to as an absorbing material that extends the length of the chamber. In one embodiment, the absorbing material may be in the form of a polyurethane, neoprene, or silicone material. Alignment of multiple chambers, each comprised of the fluid responsive material, encased within the annular body, effectively forms a tube. The axial mass shown and described in FIGS. 1-5 may be employed with the alternate chamber material.

The mass employed in conjunction with the aligned chambers reduces the mechanical shock, as described herein, and pulls the suppressor away from the barrel of the firearm. The mass further reduces shock or suddenness of the signature sound of the shot and shot concussion. Accordingly, the use of the axial mass within the body of the suppressor and in conjunction with the axially variable volume chambers reduces an ability to identify a location of the shooter based on the sound of the shot fired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a tubular housing defining a hollow interior surrounding a path along which a projectile can travel;

the tubular housing having a first end and a second end, the first end in communication with the muzzle end of a firearm, and the second end oppositely disposed, the tubular housing comprising:

a plurality of dynamic volume chambers disposed between the first end and the second end and each chamber having axial apertures aligned with the projectile path;

an axial mass having a proximal end positioned proximate to the first end of the housing, and a distal end in communication with a first dynamic volume chamber, the mass consisting of a single aperture, wherein the aperture is aligned with the projectile path; and the mass having a non-uniform outer profile, with a detent and an indent, wherein the non-uniform profile in conjunction with axial movement of the mass removes debris from an internal wall of the housing.

2. The apparatus of claim 1, further comprising a ring adjacently positioned between the proximal end of the mass and the first end of the housing.

3. The apparatus of claim 2, wherein the ring is comprised of a silicone material.

4. The apparatus of claim 1, further comprising a separator positioned between two adjacently positioned chambers.

5. The apparatus of claim 1, wherein the separator is comprised of a metallic material.

6. The apparatus of claim 1, further comprising an adapter having a first end and a second end, the first end secured to the muzzle end of the firearm and the second end secured to the first end of the tubular housing, and the adapter having an axial aperture aligned with the projectile path.

7. The apparatus of claim 6, further comprising the first end of the adapter having threads sized to be received and secured to the muzzle end of the firearm.

8. The apparatus of claim 6, wherein the second end of the adapter having threads to be received by the first end of the tubular housing.

9. The apparatus of claim 1, further comprising the aperture having a tapered internal opening with a larger opening adjacent to the first end and a smaller opening adjacent to the second end.

10. The apparatus of claim 9, wherein the larger opening functions as an expansion chamber for gas emitted from a projectile and facilitates axial movement of the mass within the housing.

11. The apparatus of claim 1, wherein the position of the mass within the housing supports a presentation of a subsequent projectile for loading, and wherein the presentation enables continuity of firing of adjacently positioned projectile rounds.

12. An apparatus comprising:

a tubular housing defining a hollow interior surrounding a path along which a projectile can travel;

the tubular housing having a first end and a second end, the first end in communication with the muzzle end of a firearm, and the second end oppositely disposed, the tubular housing comprising:

a plurality of dynamic volume chambers disposed between the first end and the second end and each chamber having axial apertures aligned with the projectile path;

an axial mass having a proximal end positioned proximate to the first end of the housing, and a distal end in communication with a first dynamic volume chamber, the mass consisting of a single aperture, wherein the aperture is aligned with the projectile path; and the aperture having a tapered internal opening with a larger opening adjacent to the first end and a smaller opening adjacent to the second end, wherein the larger opening functions as an expansion chamber for gas emitted from a projectile and facilitates axial movement of the mass within the housing.

13. The apparatus of claim 12, further comprising a ring adjacently positioned between the proximal end of the mass and the first end of the housing.

14. The apparatus of claim 13, wherein the ring is comprised of a silicone material.

15. The apparatus of claim 12, further comprising a separator positioned between two adjacently positioned chambers.

16. The apparatus of claim 12, further comprising an adapter having a first end and a second end, the first end secured to the muzzle end of the firearm and the second end secured to the first end of the tubular housing, and the adapter having an axial aperture aligned with the projectile path.

17. The apparatus of claim 16, further comprising the first end of the adapter having threads sized to be received and secured to the muzzle end of the firearm.

18. The apparatus of claim 16, wherein the second end of the adapter having threads to be received by the first end of the tubular housing.

19. The apparatus of claim 12, further comprising the mass having a non-uniform outer profile, with a detent and an indent.

20. The apparatus of claim 18, wherein the non-uniform profile in conjunction with axial movement removes debris from an internal wall of the housing.

21. The apparatus of claim 12, wherein the position of the mass within the housing supports a presentation of a subsequent projectile for loading, and wherein the presentation enables continuity of firing of adjacently positioned projectile rounds.

* * * * *